US005520070A

United States Patent [19]

Beugelsdyk et al.

[11] Patent Number: 5,520,070

[45] Date of Patent: May 28, 1996

[54] REMOTE VALVE CONTROL ASSEMBLY

[75] Inventors: Anthony F. Beugelsdyk; Ed Eater; Michael A. Barnard, all of Wichita, Kans.

[73] Assignee: Wescon Products Company, Wichita, Kans.

[21] Appl. No.: 348,350

[22] Filed: Dec. 2, 1994

[51] Int. Cl.[6] ..... G05G 5/06

[52] U.S. Cl. ..... 74/528; 74/527; 74/543; 74/545

[58] Field of Search ..... 74/527, 528–548; 192/4 A

[56] References Cited

U.S. PATENT DOCUMENTS

| | | | |
|---|---|---|---|
| 3,143,894 | 8/1964 | Tennis | 74/528 X |
| 3,525,272 | 8/1970 | Olson | 74/528 |
| 4,069,723 | 1/1978 | Payerle | 74/548 |
| 4,090,598 | 5/1978 | Prince | 74/528 X |
| 4,222,474 | 9/1980 | Choudhury et al. | 74/528 |
| 4,926,688 | 5/1990 | Murasaki | 74/527 |
| 4,934,496 | 6/1990 | Barske et al. | 192/4 A |
| 5,025,901 | 6/1991 | Kito et al. | 192/4 A |
| 5,156,065 | 10/1992 | Fujimoto et al. | 74/527 |
| 5,214,980 | 6/1993 | Saeda et al. | 74/528 X |
| 5,379,872 | 1/1995 | Dörr et al. | 74/527 |

FOREIGN PATENT DOCUMENTS

| | | | |
|---|---|---|---|
| 3433092 | 3/1986 | Germany | 74/528 |
| 62-37324 | 3/1987 | Japan | 74/528 |
| 1-32105 | 10/1989 | Japan | 74/528 |
| 335245 | 12/1958 | Switzerland | 74/528 |

*Primary Examiner*—Vinh T. Luong
*Attorney, Agent, or Firm*—Hovey, Williams, Timmons & Collins

[57] ABSTRACT

A remote valve control assembly broadly includes a lever assembly, a control plunger operably coupled with the lever assembly, and a case structure having a pair of case halves. The lever assembly includes a lever and a control handle having a detent pin. The case structure includes interior structure presenting a pivot and a plunger channel. The case structure also includes a single position detent slide mounted on one case half, and a double position detent slide on the other case half. The lever is retained in the case structure on the pivot for relative pivotal movement of the lever assembly between forward and aft positions. The detent pin is adapted to engage at least one of the detent slides for retaining the lever assembly in a desired position. The control handle is configured to selectively disengage the detent pin from the detent slides for movement of the lever assembly. The detent pin is shiftable between a single detent position for engaging the single position detent slide, and double detent position for engaging the double position detent slide. As a result, the control assembly may be placed in a single detent mode for retaining the rotating lever in a center position, and a double detent mode for retaining the rotating lever in the forward and aft positions.

9 Claims, 3 Drawing Sheets

28
16
22
24
26
46
38
62
36
32
40

18
34
10
44
20
42
21

12
30

14
4

REMOTE VALVE CONTROL ASSEMBLY

BACKGROUND OF THE INVENTION

1. Field of the Invention

The present invention relates to devices for remotely controlling equipment by manipulation of components such as valves, handles, arms, covers, switches, and the like, through a mechanical linkage such as cables, rods, or arms. The invention relates in particular to devices which remotely control the condition of such equipment, in the manners described, and wherein means is provided to shift the device from one mode of operation requiring a certain pattern of adjustment, such as a single resting position, to another mode of operation requiring a separate pattern of adjustment, such as multiple resting positions.

2. Discussion of the Prior Art

It is known to provide a mechanically linked control for the remote operation of various types of equipment requiring the manipulation of devices such as valves, handles, arms, covers, switches and the like. For example, it has been known to remotely control such equipment through the application of a lever assembly comprising a control handle attached to a lever which linearly positions a control plunger as the lever rotates. However, such prior art lacks the capability to retain the control plunger in a desired position, and, therefore, lacks the utility of the remote valve control assembly.

It is also known to provide a control assembly comprising a control handle tube and inner handle rod which is inserted through the control handle tube, and having an engagable detent pin which engages an exterior detent slide. Such prior art devices have the ability to retain the control plunger in a desired position. However, they lack the capability to be shifted to another mode of operation, where different positions may be selected. This factor increases the manufacturing cost, and, therefore, the cost to the consumer, while decreasing the utility of the prior art devices. Additionally, such prior art devices lack the protection of the present invention against damage caused by foreign materials because many of the components of the known remote valve controls are exposed.

SUMMARY OF THE INVENTION

It is an object of the present invention to provide a remote valve control assembly wherein a lever assembly provides a means for adjusting the position of a control plunger which, through a mechanical control linkage, adjusts the position of a device or devices including such devices as valves, handles, arms, covers, and switches for the remote operation of various equipment, examples of which include farm equipment, flow restricting valves, water craft motors, and other types of engines.

It is a further object of the present invention to provide a remote valve control assembly wherein a shiftable detent pin provides a means for setting the remote valve control assembly into different modes of operation so that the lever assembly and connected control plunger may be retained in various desired positions.

It is another object of the invention to provide a remote valve control assembly wherein the case structure provides protection for the internal components of the remote valve control assembly from damage caused by foreign materials.

It is yet a further object of the present invention to provide a remote valve control assembly which is less costly to manufacture than the prior art devices through uniform manufacture of remote valve control assemblies intended for different modes of operation, such as single position detent mode, or multiple position detent mode, and to provide a remote valve control assembly which may be used in several different applications requiring a minimum amount of adjustment.

The remote valve control assembly includes a lever assembly and a case structure. The lever assembly consists of a control handle, which is used to manipulate the remote valve control assembly, and a rotating lever. A control plunger, in communication with the lever, travels in a linear motion as the lever is rotated by the control handle.

The case structure is formed by mating the two case halves, left and right, which may be joined by use of a fastening element such as bolts, screws, adhesives, or a combination of such fastening elements. When mated, the case halves define an interior structure which provides a pivot which secures the lever, and a channel for the control plunger.

The lever is partially exposed through an opening in the case structure. The control handle is attached to the lever and extends through the opening in the case structure. The lever is designed such that it covers the opening in the case structure, thus protecting the interior components from foreign material.

The control handle comprises a control handle tube with an interior space, and an inner handle rod which is inserted in the interior space of the control handle tube and rests on a return spring.

A shiftable detent pin is attached to the inner handle rod and extends through an opening in the wall of the control handle tube. The shiftable detent pin engages a detent recess in a detent slide. Detent slides are located on the interior structure of the case halves. The detent slides may be attached to the interior wall by means of a fastening element such as bolts, screws, adhesives, or a combination of such elements, or the detent slides may be molded as part of the interior structure of the case halves. The shiftable detent pin may be shifted so that it engages only one detent slide.

The detent slides may be one position detent slides or multiple position detent slides. For example, the one position detent slides have one detent recess, and the double detent slides have two detent recesses.

Depression of the inner handle rod until it is in the down position causes the shiftable detent pin to disengage itself from a detent slide, allowing rotation of the lever assembly and linear movement of the control plunger.

The inner handle rod is returned to the upright position after the depressing force is removed by means of a return spring. A knob may be mounted on the inner handle rod so provide more comfortable operation of the remote valve control assembly.

BRIEF DESCRIPTION OF THE DRAWINGS

A preferred embodiment of a remote valve control assembly is described below with reference to the attached drawing figures, wherein.

DETAILED DESCRIPTION OF THE PREFERRED EMBODIMENT

Figures 1, 2, 3, 4, 4A:
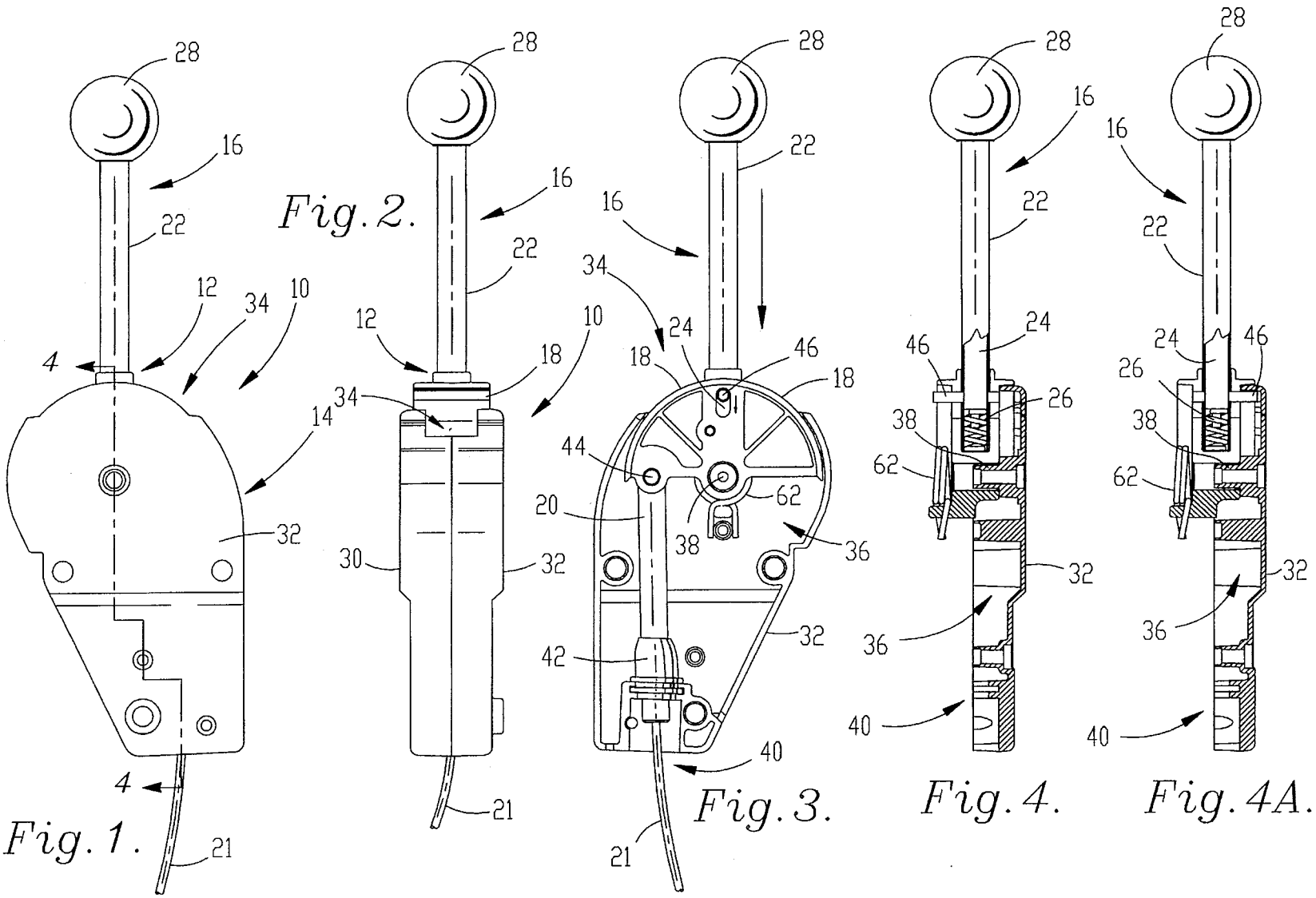
FIG. 1 is a right side elevational view of the remote valve control assembly depicting the control lever assembly in the center position.
FIG. 2 is a front elevational view of the remote valve control assembly depicted in FIG. 1.
FIG. 3 is a left elevational cut-a-way view of the remote valve control assembly depicted in FIG. 1.
FIG. 4 is a front elevational cut-a-way view of the remote valve control assembly taken on line 4—4 of FIG. 1 with the shiftable detent pin set to double position detent mode.
FIG. 4A is a front elevational cut-a-way view of the remote valve control assembly taken on line 4—4 of FIG. 1 with the shiftable detent pin set to single position detent mode.

The remote valve control assembly 10 includes a lever assembly 12 and a case structure 14. Lever assembly 12, shown in FIG. 3, comprises a control handle 16 mounted on a rotating lever 18. Lever 18, which is in communication with a control plunger 20, is manipulated by control handle 16. Manipulation of lever 18 causes linear movement of control plunger 20. Control plunger 20 is linked to a control linkage 21, so that as control plunger 20 undergoes linear movement, control linkage 21 undergoes the linear movement.

Control handle 16 comprises a control handle tube 22 with an interior space, and an inner handle rod 24 which is inserted through the interior space of control handle tube 22 and which rests on a return spring 26 located in the base of tube 22. For operational comfort, a knob 28 is mounted on inner handle rod 24.

Case structure 14 comprises opposed case halves, left case half 30 and right case half 32, which when joined define an opening 34, as disclosed in FIG. 2, and an interior structure 36. Interior structure 36, as disclosed in FIGS. 3, 4 and 4A, provides a pivot 38 securing and allowing rotational movement of lever assembly 12 and a control plunger channel 40 to which a retaining grommet 42 is attached allowing two-directional linear movement of the control plunger. Grommet 42 prevents foreign material, such as water and dirt, from entering the interior portion of joined case halves 30 and 32.

Movement of control handle 16 causes lever 18 to rotate around pivot 38 thereby causing linear movement of control plunger 20 which is in communication with lever 18 by means of a retaining pin 44.

Retention of lever assembly 12 is accomplished by employing a shiftable detent pin 46 which is attached to inner handle rod 24 and extends through an opening in the wall of control handle tube 22. Shiftable detent pin 46 may be set so that it engages one of two detent slides which are attached to each case half 30 and 32.

A single position detent slide 48 having one detent recess 50 is attached to one case half, while a double position detent slide 52 having two detent recesses 50 is attached to the opposite case half.

Detent slides 48 and 52 may be attached to case halves 30 and 32 by means of fastening elements such as bolts, screws, adhesives, or a combination of those elements, or they may be permanently molded as part of the interior structure of the case halves. The latter method is disclosed in FIGS. 5 and 6.

Remote valve control assembly 10 may be set to a single detent mode by shifting detent pin 46 so that it engages single position detent slide 48. Alternatively, assembly 10 may be set to a double detent mode by shifting detent pin 46 so that it engages double position detent slide 52.

Figure 5:
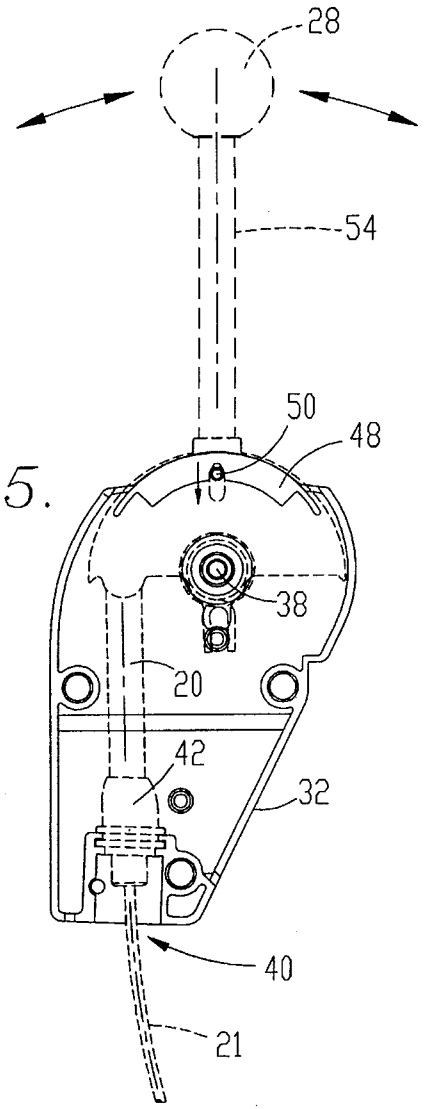
FIG. 5 is a left elevational cut-a-way view of the remote valve control assembly with the lever assembly retained in the center position as depicted in FIG. 4A, and denoting the two directional movement of the control handle assembly.

As diclosed in FIG. 5, single position detent slide 48 is attached to the interior of right case half 32 retaining lever assembly 12 in a center position 54. As FIG. 5 illustrates, retention of lever assembly 12 in center position 54 is accomplished when shiftable detent pin 46 engages detent recess 50 of single position detent slide 48.

Figure 6:
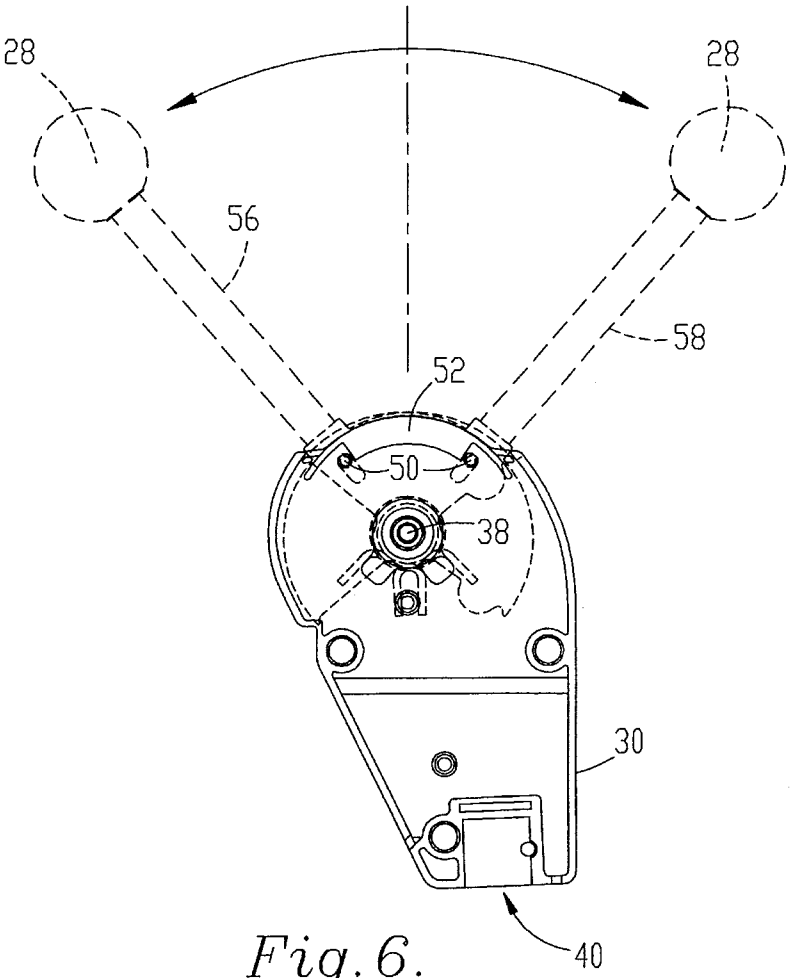
FIG. 6 is a right elevational cut-a-way view of the remote valve assembly depicted in FIG. 4, illustrating the forward and aft positions into which the control handle assembly may be manipulated when in double position detent mode.

FIG. 6 discloses double position detent slide 52 attached to the interior of left case half 30 retaining lever assembly 12 in a forward position 56 or an aft position 58. As FIG. 6 illustrates, retention of lever assembly 12 is accomplished when shiftable detent pin 46 engages one of detent recesses 50 located at each end of double position detent slide 52.

Figure 11:
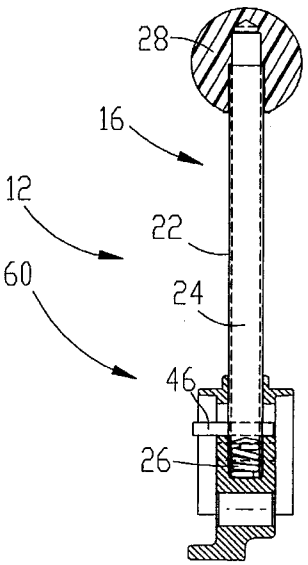
FIG. 11 is a view of the lever assembly taken on line 11—11 of FIG. 10 with the inner handle rod in the down position.
Figure 10:
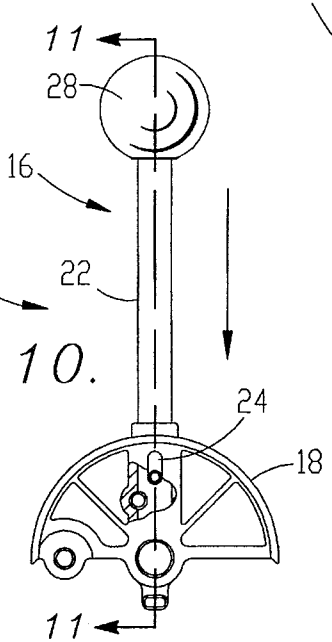
FIG. 10 is a left side elevational view of the lever assembly without the torsion spring with a partial section view of the inner handle rod.
Figure 9:
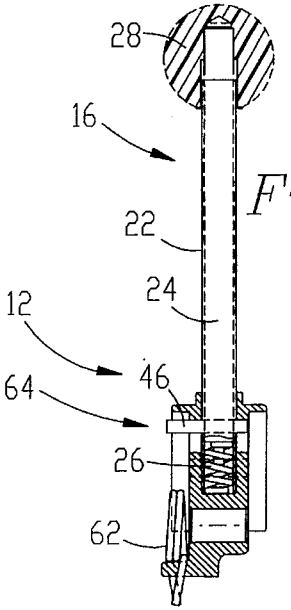
FIG. 9 is a view of the lever assembly taken on line 9—9 of FIG. 8 with the inner handle rod in the upright position.
Figure 8:
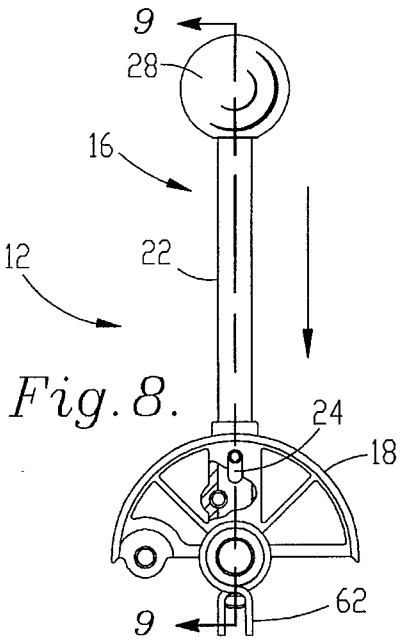
FIG. 8 is a left side elevational view of the lever assembly with a partial section view of the inner handle rod.
Figure 7:
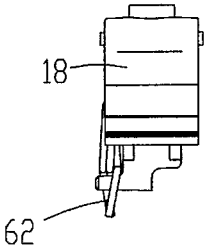
FIG. 7 is a front elevational view of the lever and torsion spring.

Rotation of lever assembly 12 is accomplished by depressing inner handle rod 24 in a downward movement, as illustrated in FIGS. 10 and 11, until inner handle rod 24 is in a downward position 60 and shiftable detent pin 46 is no longer engaging either detent slide, and then moving control handle assembly 16 in the desired direction.

When inner handle rod 24 is in downward position 60 so that shiftable detent pin 46 is no longer engaging either detent slide, and no rotational force is applied, a torsion spring 62 causes lever assembly 12 to rotate to center position 54.

Return spring 26 causes inner handle rod 24 to return to upright position 64 when the depressing force is removed and shiftable detent pin 46 is positioned so that it may engage one of detent recesses 50. Lever assembly 12 is retained when inner handle rod 24 is in an upright position 64.

Remote valve control assembly 10 may be mounted so that an operator may remotely control the condition of equipment which requires the manipulation of components such as valves, handles, arms, covers, switches and the like through control linkage 21 which may take the form of cables, rods, arms, or the like.

Control linkage 21 is connected to both the remote component, such as a valve, handle, arm, cover, switch, or the like, and control plunger 20 so that as control handle 16 is manipulated, control plunger 20 causes control linkage 21 to undergo linear movement which causes manipulation of the remote component.

Remote valve control assembly 10 has case structure 14 which encloses its working components, making the present invention inherently protective of those working components from foreign objects, such as water, dirt, and dust, which cause known controls to have to be frequently disassembled, cleaned, and lubricated. Remote valve control assembly 10 is also inherently protective of its internal working components from damage caused by larger and/or heavier foreign objects such as stones, work tools, and other work equipment.

Remote valve control assembly 10 may be used for at least two separate functions by shifting detent pin 46. This function makes remote valve control assembly 10 less expensive to manufacture, and allows the consumer to purchase one remote valve control assembly 10 for at least two different applications, those requiring a single position detent mode, as well as those which require a double position detent mode.

Although the present invention has been described with reference to the illustrated preferred embodiment, it is noted that variations and changes may be made and equivalents employed herein without departing from the scope of the invention as recited in the claims.

We claim:

1. A remote valve control assembly comprising:

a lever assembly including a lever and a control handle having a detent pin;

a control plunger operably coupled with the lever assembly; and a case structure including a pair of case halves having an interior structure presenting a pivot and a control plunger channel, and a single position detent slide mounted on one of the case halves and a double position detent slide mounted on the other of the case halves, the pivot being adapted to secure the lever assembly to the case structure and permit rotation of the lever assembly between first and second positions, the channel being adapted to permit movement of the control plunger, and the detent pin adapted for engagement with at least one of the detent slides for retaining the lever assembly in a desired position, the control handle including disengaging means for selectively disengaging the detent pin from the detent slides for permitting rotation the lever assembly.

2. The remote valve control assembly as set forth in claim 1, wherein the detent pin is configured to be shifted between a single detent position where the pin is adapted to engage the single position detent slide, and a double detent position where the pin is adapted to engage the double position detent slide.

3. The remote valve control assembly as set forth in claim 1, wherein the single position detent slide is configured to be engaged by the detent pin to retain the lever assembly in a center position.

4. The remote valve control assembly as set forth in claim 1, wherein the double position detent slide is configured to be engaged by the detent pin to retain the lever assembly in one of the first and second positions.

5. The remote valve control assembly as set forth in claim 1, the disengaging means including a control handle tube with an interior space, and a inner handle rod which is inserted through the interior space of the control handle tube, wherein the inner rod is adapted for linear movement between a lowered position and an upright position and the shiftable detent pin is attached to the inner handle rod and extends through an opening in at least one wall of the control handle tube.

6. The remote valve control assembly as set forth in claim 5, wherein the inner handle rod is adapted to be depressed toward the lowered position for disengaging the detent pin from detent slides for permitting rotation of the lever assembly.

7. The remote valve control assembly as set forth in claim 6, wherein the control handle further includes means for returning the inner handle rod toward the upright position.

8. The remote valve control assembly as set forth in claim 7, wherein the means for returning the inner handle rod toward the upright position includes a compression spring.

9. The remote valve control assembly as set forth in claim 1, said detent slides are integral with the interior structure of each case half.

* * * * *